US005301705A

United States Patent [19]

Zheng

[11] Patent Number: 5,301,705

[45] Date of Patent: Apr. 12, 1994

[54] COLLAPSIBLE SHADE STRUCTURE

[76] Inventor: Yu Zheng, 1065 Howard Ave., Covina, Calif. 91722

[21] Appl. No.: 764,784

[22] Filed: Sep. 24, 1991

[51] Int. Cl.[5] ..... E04H 15/40

[52] U.S. Cl. ..... 135/104; 135/106; 135/905

[58] Field of Search ..... 135/104, 93, 91, 106, 135/102

[56] References Cited

U.S. PATENT DOCUMENTS

| | | | |
|---|---|---|---|
| 3,675,667 | 7/1972 | Miller . | |
| 3,880,459 | 4/1975 | Kelley | 135/93 X |
| 3,960,161 | 6/1976 | Norman . | |
| 3,990,463 | 11/1976 | Norman . | |
| 4,165,757 | 8/1979 | Marks | 135/93 |
| 4,265,261 | 5/1981 | Barker | 135/93 X |
| 4,716,918 | 1/1988 | Hayashida et al. | 135/93 |
| 4,815,784 | 3/1989 | Zheng . | |
| 4,825,892 | 5/1989 | Norman . | |
| 4,858,634 | 8/1989 | McLeese . | |
| 4,951,333 | 8/1990 | Kaiser et al. . | |
| 5,024,262 | 6/1991 | Huang . | |
| 5,038,812 | 8/1991 | Norman . | |
| 5,137,044 | 8/1992 | Brady | 135/104 |

FOREIGN PATENT DOCUMENTS 2635136 2/1990 France .

*Primary Examiner*—Carl D. Friedman
*Assistant Examiner*—Lan M. Mai
*Attorney, Agent, or Firm*—Raymond Sun

[57] ABSTRACT

A collapsible shade structure includes a plurality of foldable frame members each having a folded and an unfolded orientation. A fabric material is provided for substantially covering the frame members to form a side panel for each frame member, each side panel assuming the unfolded orientation of its associated frame member. Interconnecting portions of the fabric material form a hinge portion between each frame member. The structure may be folded and stored by folding the side panels and their corresponding frame members on top of each other about the hinge portions to have the side panels and frame members overlying each other. The overlaying side panels and frame members are then collapsed by twisting and folding to form a plurality of concentric frame members and side panels to substantially reduce the size of the shade structure.

16 Claims, 11 Drawing Sheets

FIG. 6A
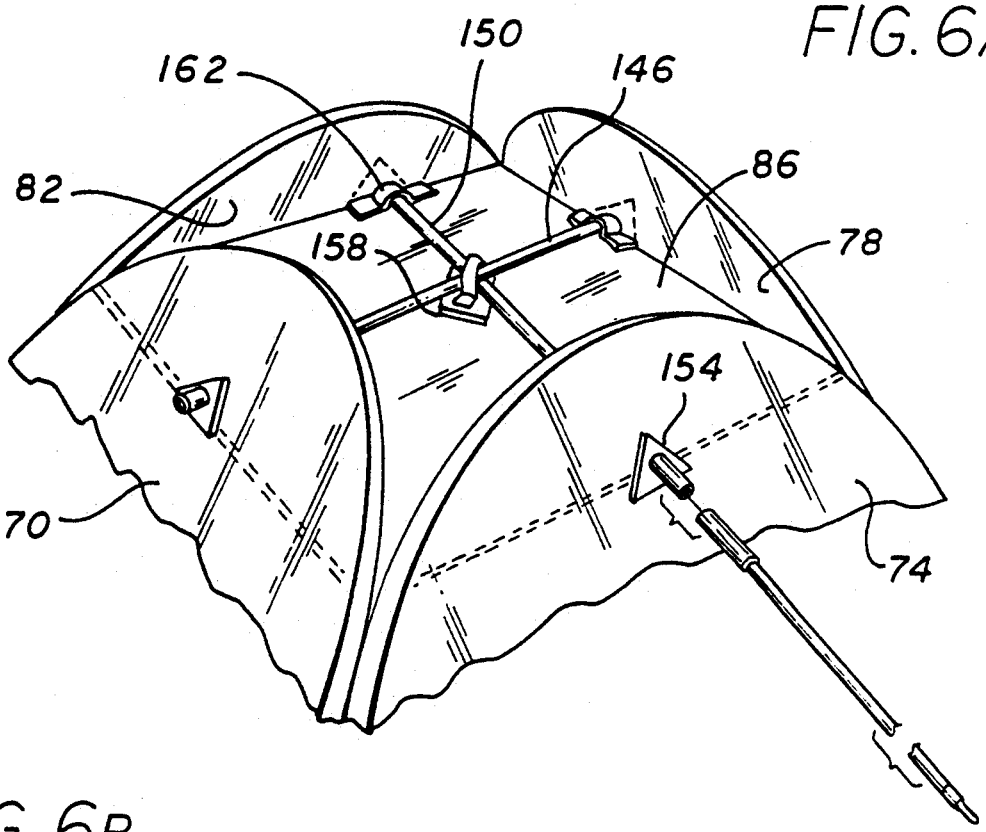
FIG. 6B
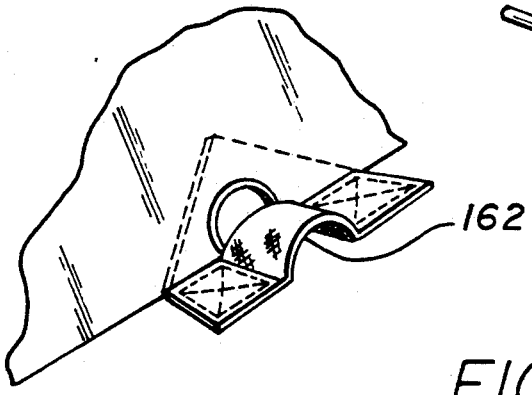
FIG. 6C
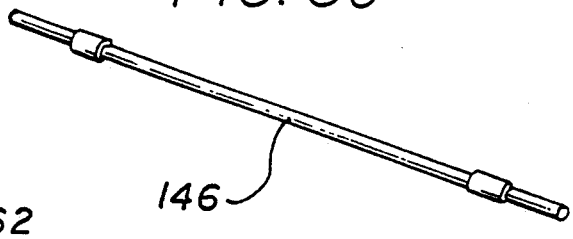
FIG. 6D
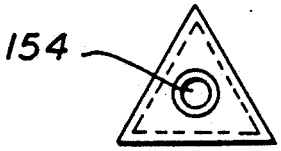
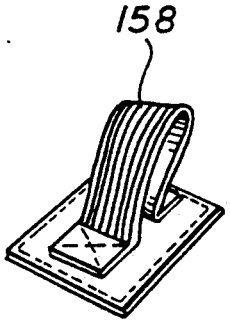
FIG. 6E
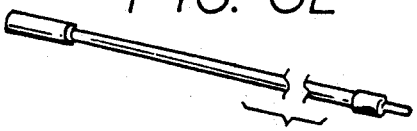
FIG. 6F FIG. 7
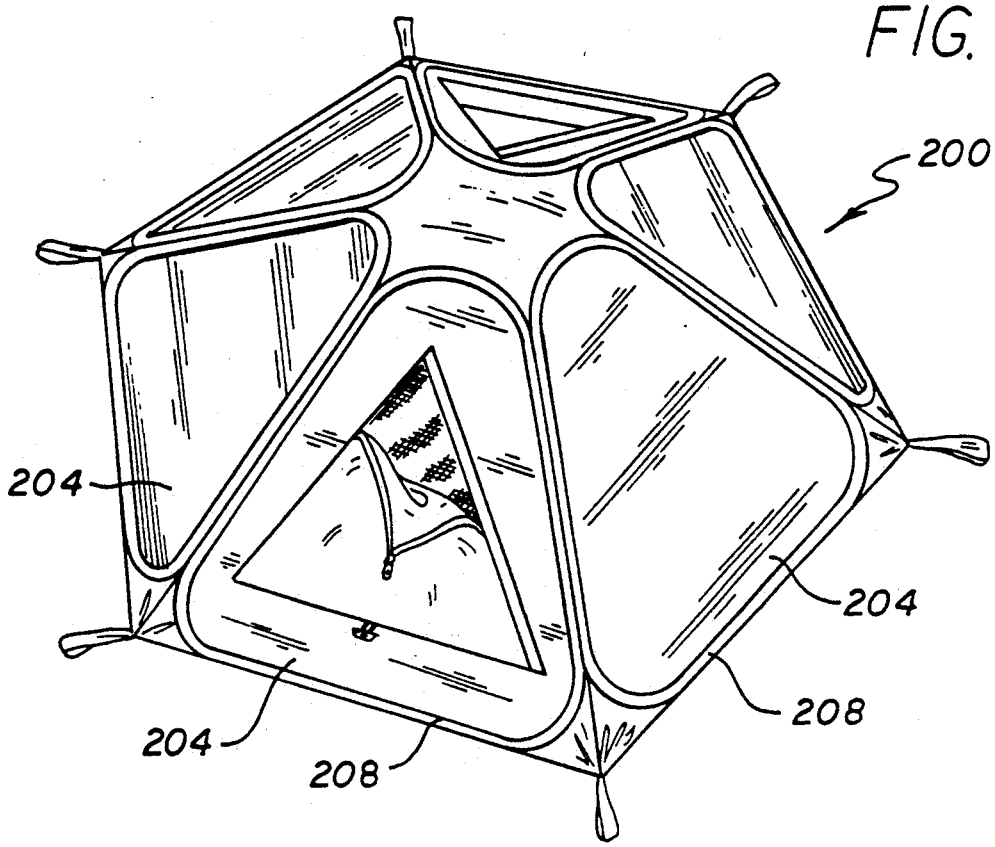
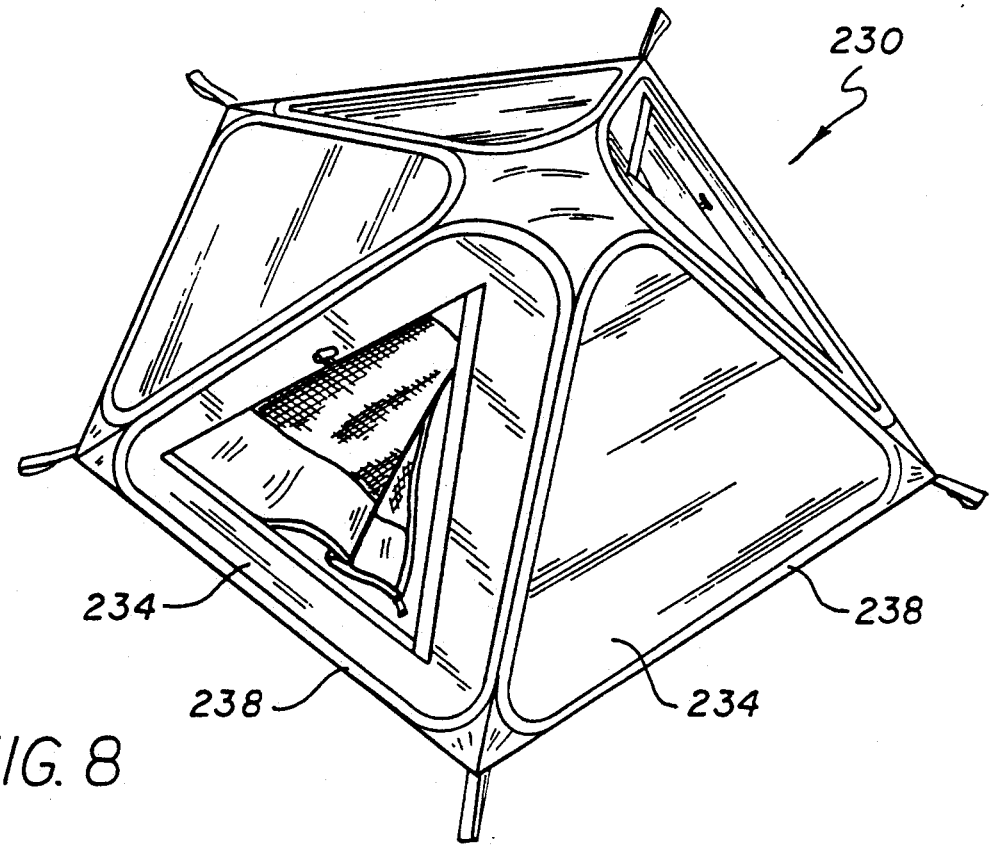
FIG. 8

FIG. 11(E)
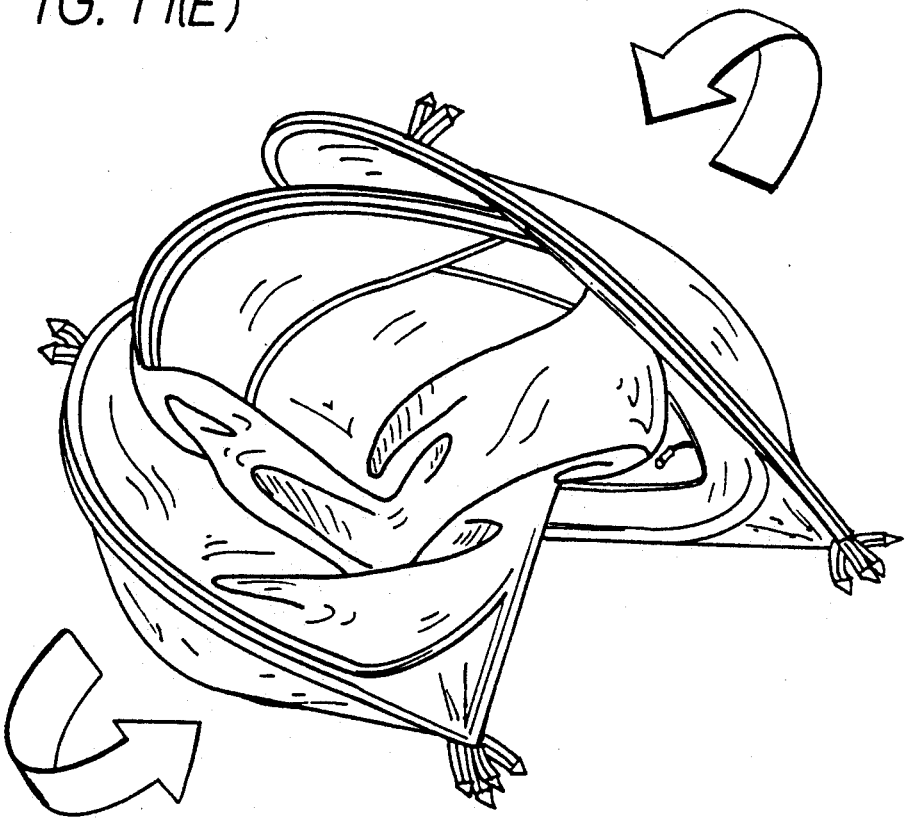
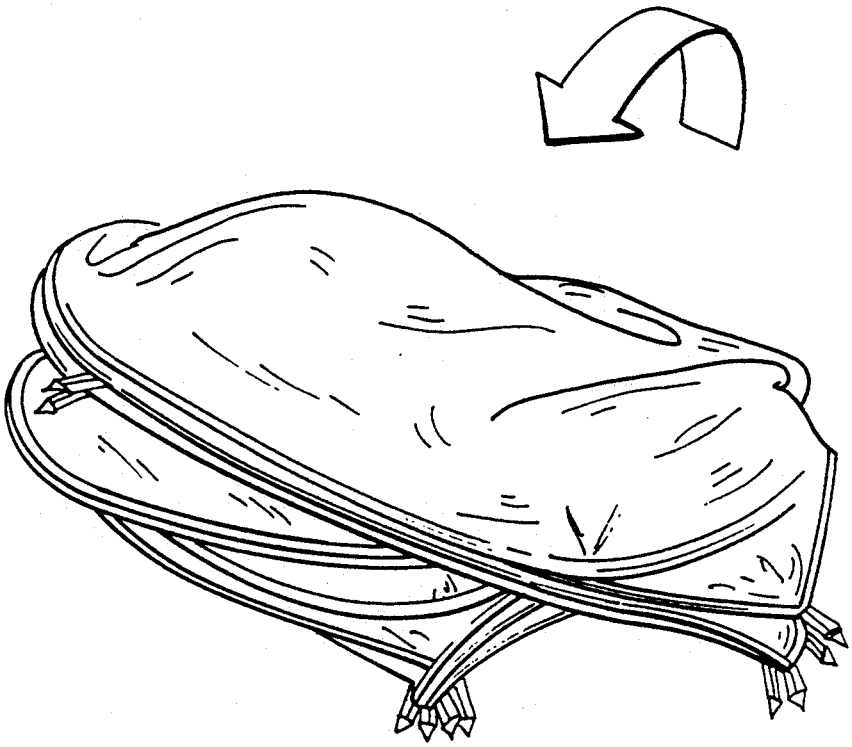
FIG. 11(F)

COLLAPSIBLE SHADE STRUCTURE

BACKGROUND OF THE INVENTION

1. Field of the Invention

The present invention relates to collapsible shade structures and specifically to collapsible or folding tents. The shade structure of the present invention provides an integral structure capable of supporting itself to act as a shelter.

2. Description of the Prior Art

Prior art collapsible shade structures have suffered from several drawbacks. One drawback with such collapsible shade structures is the difficulty associated with erecting and stably supporting such structures. Another drawback associated with these prior art collapsible shade structures is that the construction of such structures tend to be complicated, bulky and are therefore troublesome to fold away and to store.

A further drawback of such prior art collapsible shade structures is that the structure itself tends to be weak even after it has been erected, and often requires other means to provide the required structural integrity. An example of such a structure is U.S. Pat. No. 3,990,463, which discloses a flexible and coilable frame member which allows for the structure to be easily collapsed and stored when not in use. The frame member is secured to the fabric of the structure and is held in a "figure-eight" configuration with the cross-over of the figure-eight as the apex of the structure and the loops of the figure-eight extending downwardly therefrom to provide support for the structure. Since the cross-over of the figure-eight frame member can only effectively support two of the side panels, tie members are provided at the lower corners of the structure and are located so as to tension and support the other two side panels. The tie members are therefore required to stabilize the frame and to hold the frame and the remainder of the structure upright because the frame member alone cannot accomplish this.

Another example is U.S. Pat. No. 3,960,161, which discloses a portable structure similar to that described in U.S. Pat. No. 3,990,463, in which the structure is supported by a flexible coilable frame member secured to the fabric. The structure in U.S. Pat. No. 3,960,161 also requires tie members at the lower corners of the structure to provide support and stability in use, and to tension the fabric by pulling downwardly and outwardly from the frame member.

The various existing collapsible shade structures have not been successful in providing a simple structure which is easy to erect and may be folded to a compact size for ease of storage, in which the structure when erected is capable of stably supporting itself. The present invention, therefore, provides for an improvement over the prior art collapsible shade structures and provides a collapsible shade structure with a novel frame structure in which the structure when erected is capable of stably supporting itself, and which also allows the collapsible shade structure to be of simple construction, to be easily erected and easily folded to a compact size to facilitate ease of storage.

SUMMARY OF THE DISCLOSURE

In order to accomplish the objects of the present invention, the collapsible shade structure is made of a plurality of foldable frame members each having a folded and an unfolded orientation. Four or more of such frame members are configured to form an interior space. A fabric material is provided which substantially covers the frame members to form a side panel for each frame member, each side panel assuming the unfolded orientation of its associated frame member. Interconnecting portions of the fabric material form a hinge portion between each frame member. A roof formed from the fabric material interconnects the upper portions of the side panels.

When the structure is to be folded and stored, the side panels and their corresponding frame members may be folded on top of each other about the hinge portions to have the side panels and frame members overlaying each other. The overlying side panels and frame members are then collapsed by twisting and folding to form a plurality of concentric frame members and side panels to substantially reduce the size of the shade structure in the folded orientation.

The collapsible shade structure may be used as a shelter affording a camper, for example, the convenience of a tent which may be easily erected and easily collapsed and folded to a compact arrangement that is a fraction of its unfolded size for easy storage. The materials used are lightweight, and together with its compact size, the tent is very convenient to transport.

BRIEF DESCRIPTION OF THE DRAWINGS

Further objects, advantages and features of the invention will become apparent from the detailed description of the preferred embodiments when read in conjunction with the accompanying drawings, in which:

FIG. 6A represents a perspective view of a roof which may be used with the collapsible shade structure of FIG. 1;

FIGS. 6B–6F illustrate the separate components of the roof of FIG. 6A;

FIG. 7 is a second embodiment of the collapsible shade structure having six side panels;

FIG. 8 is a third embodiment of the collapsible shade structure having five side panels;

FIGS. 11(A) through 11(F) illustrate the operation of the collapsible shade structure of FIG. 1 showing how it may be folded up for compact storage;

DETAILED DESCRIPTION OF THE PREFERRED EMBODIMENTS

The preferred embodiments of the present invention will be described in terms of tents with reference to FIGS. 1–13, although the principles and concepts are equally applicable to other collapsible shade structures. The scope of the invention is best defined by the appended claims.

Figure 1:
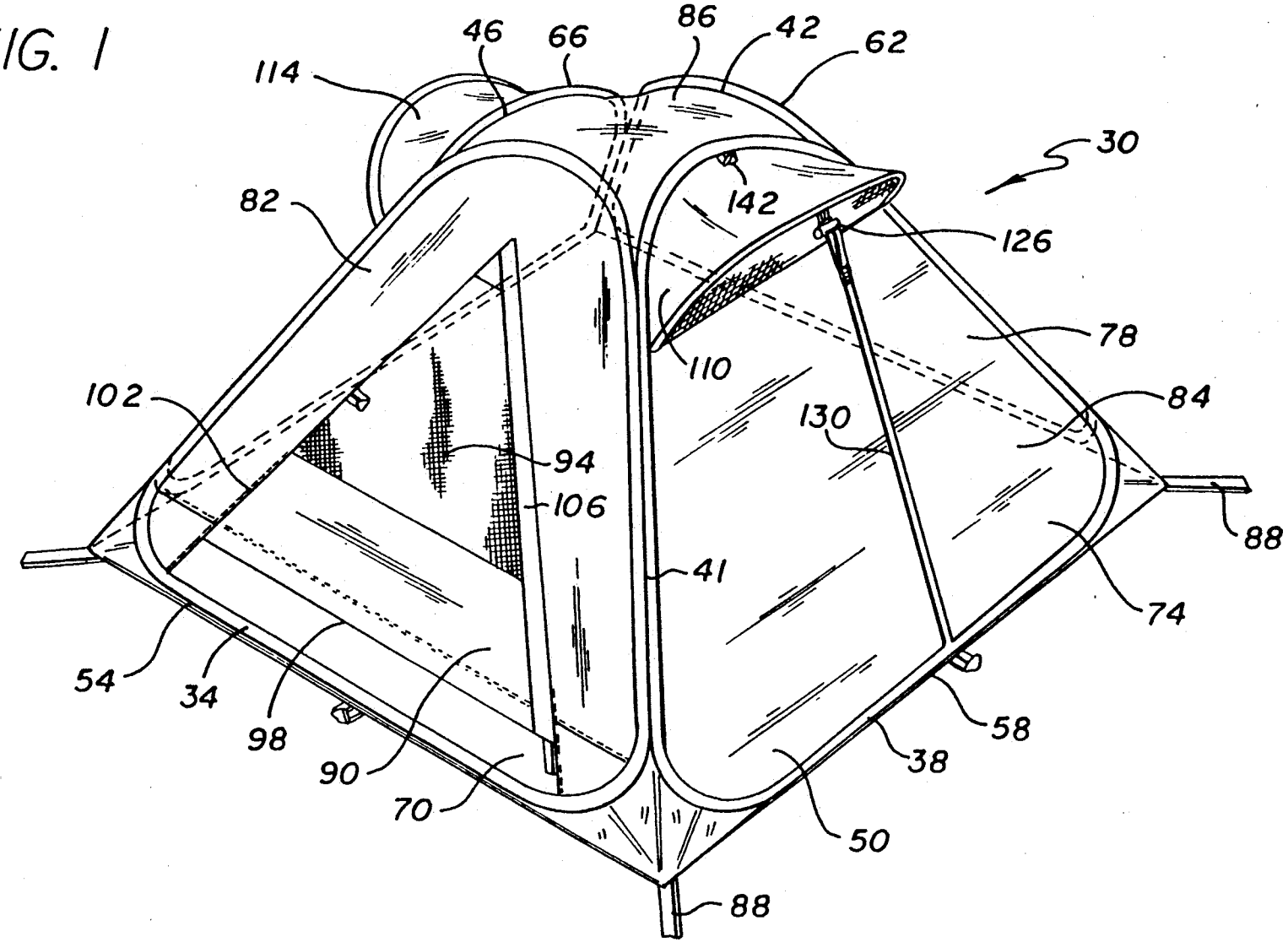
FIG. 1 is a perspective view of the collapsible shade structure having four triangular side panels.
Figure 2:
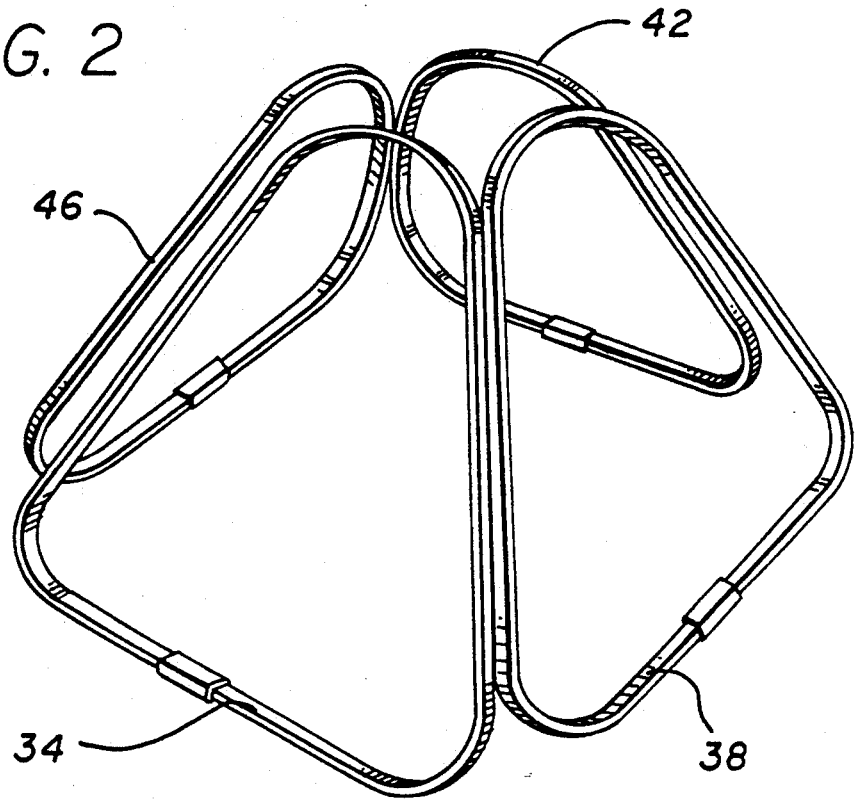
FIG. 2 is a perspective view of the internal frame structure of the collapsible shade structure of FIG. 1.
Figure 3:
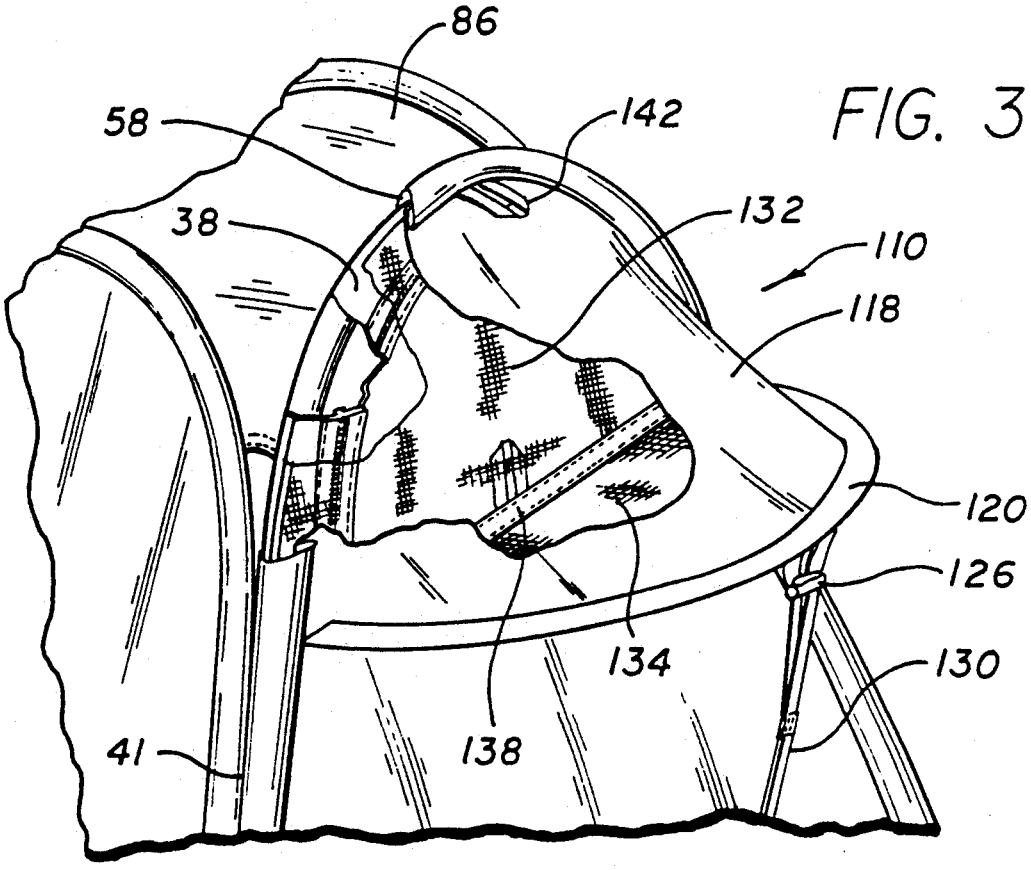
FIG. 3 is a perspective view partially broken away showing the vent of the collapsible shade structure of FIG. 1 in an open position.

As shown in FIGS. 1, 2 and 3, the basic structure for a tent 30 comprises four resilient frame members 34, 38, 42 and 46. Each of the frame members 34, 38, 42 and 46 has three sides connected by curved portions to form a triangular-shape. The frame members 34, 38, 42 and 46 are retained in position by fabric or sheet material 50, which includes internal frame retaining sleeves 54, 58, 62 and 66 for retaining the frame members 34, 38, 42 and 46, respectively. The internal frame retaining sleeves 54, 58, 62 and 66 may be provided by mechanically fastening (stitching), fusing, or gluing so that the frame members 34, 38, 42, and 46 are retained in position. The fabric 50 in conjunction with the frame members 34, 38, 42, and 46 form four triangular side panels 70, 74, 78, and 82, respectively, so that each frame member is used to support one side panel. Each side panel and its associated frame member is vertically inclined inwardly at an angle to create a domed structure in which the interior area of the structure gradually decreases from the bottom to the top Although the frame members 34, 38, 42, and 46 are described as formed of flexible steel, other materials such as plastics may be used. The frame members should be made of a material which is relatively strong and yet is flexible to a sufficient degree to allow it to be coiled. The term fabric is to be given its broadest meaning and should be made from strong, lightweight materials and may include woven fabrics, sheet fabrics or even films. The fabric should be waterproof and capable of withstanding the harsh outdoor environment to be suitable for use as an outdoor tent during camping. The fabric and frame members are preferably made of lightweight material to facilitate ease of transportation of the tent.

The tent 30 is further provided with a roof 86 which is made of the same material as fabric 50. The roof 86 is located between the upper curved portions of the side panels 70, 74, 78 and 82 and takes the form of an interconnecting fabric.

A floor portion 84 which may be made from the same material as the fabric 50 is provided to interconnect the lower edges of the side panels 70, 74, 78 and 82. Ties 88 are provided at the corners of the side panels 70, 74, 78 and 82 for securing the tent 30 to the ground. The area of the floor 84 is larger than the area of the roof 86 due to the vertically inclined side panels forming the domed structure.

The tent 30 is also provided with a door 90, preferably located in a side panel, for example, side panel 70, for ingress and egress. The door 90 is essentially a triangular-shaped cutout in the side panel 70 having a portion which is made of a fly-screen 94. The door 90 has two zipper edges 98 and 102 and a hinged edge 106. Mating zipper halves are provided along each side of the edges 98 and 102 of the door 90 and the corresponding edges of the side panel 70 to releasably hold the door 90 in a sealed position when the tent 30 is being occupied and the zippers pulled up.

Ventilation of the tent 30 is achieved through the fly-screen 94 and through vents 110 and 114 disposed at the upper curved portion of side panels 74 and 82, respectively. Vents 110 and 114 have the same construction. For example, referring to FIGS. 1, 3, 4, and 5, the vent 110 has a waterproof hood 118 which is sewn along the upper curved edges of the side panel 74. The hood 118 extends outwardly from the side panel 74 in an open position. The outer periphery 120 of the hood 118 is formed by a small steel loop 122 enclosed within the outer periphery 120 which defines the semi-circular shape of the outer periphery 120. A hinged hook 126 is provided at a central portion of the outer periphery 120. A strip 130 having one end sewn to a central portion of the bottom of side panel 74 has an opposite end which may be hooked by the hinged hook 126 to keep the hood open The upper portion of side panel 74 is made up of a mesh portion 132. The upper curved portion of the frame member 38 and an elongated steel strip 138 together define the semi-circular shape of the mesh portion 132. The outer periphery 120 of the hood 118 and the steel strip 138 define a semi-circular shape for fitting another screen mesh 134 therebetween.

Figure 5:
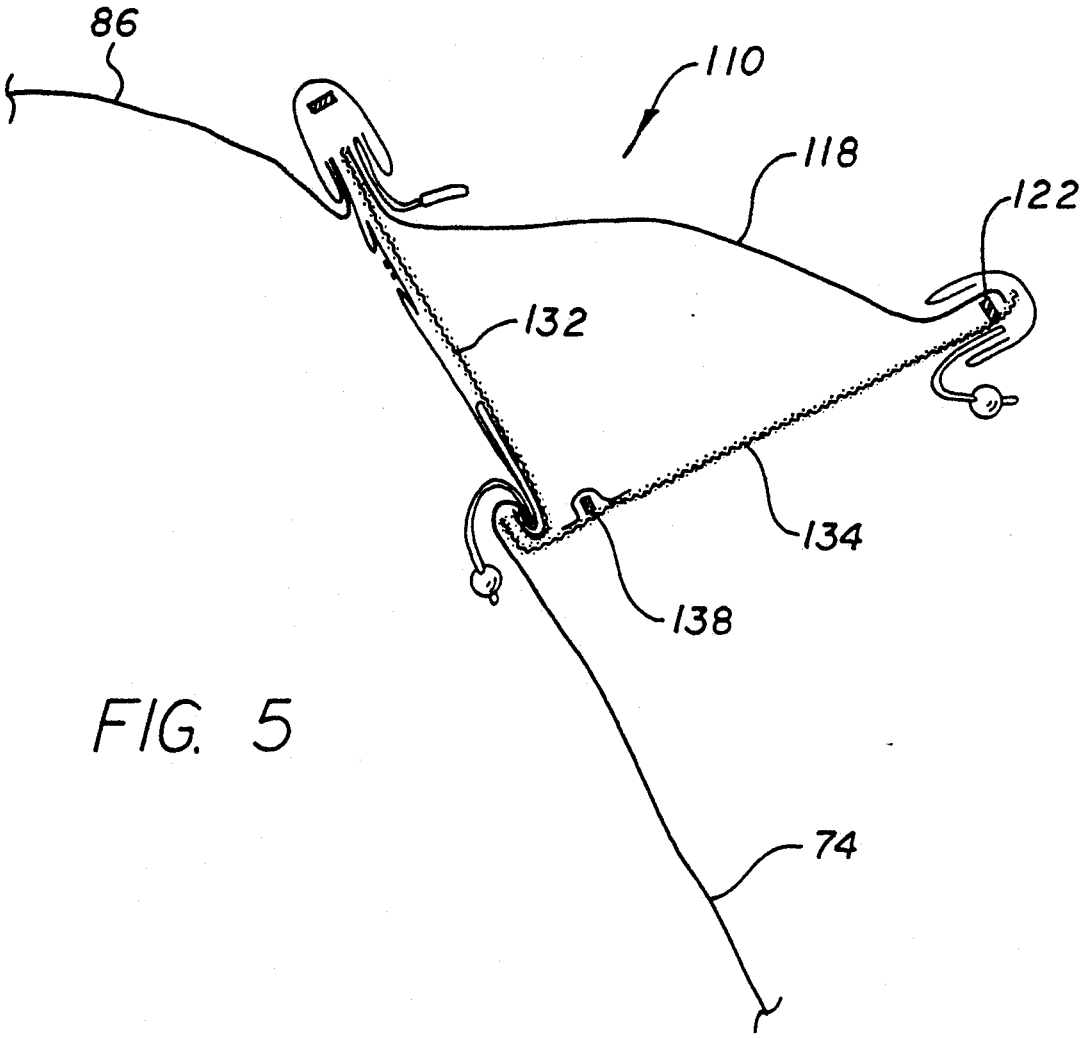
FIG. 5 is a cross-sectional side view of the vent of FIG. 3 in an open position.
Figure 4:
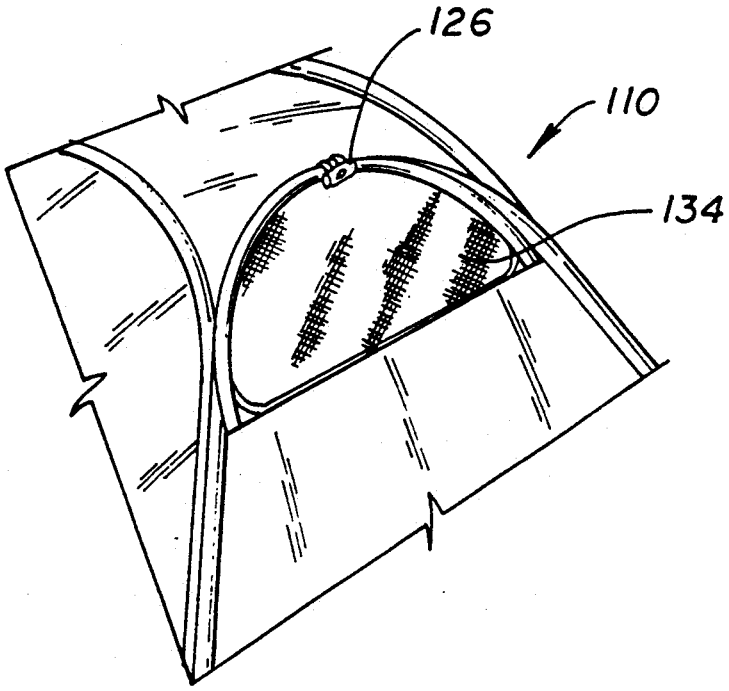
FIG. 4 is a perspective view of the vent of FIG. 3 in a closed position.

The vent 110 may be held in the open position shown in FIGS. 1, 3, and 5 by hooking the strip 130 to the hook 126. The hood 118 is retracted when the tent 30 is to be collapsed and stored. When the hood 118 is to be retracted, the strip 130 is unhooked from the hook 126, and the hood 118 is pulled upwardly so that the hinged hook 126 may be made to hook an elastic loop 142 so that the screen mesh 134 is held firmly against the mesh portion 132 of the side panel 74. Regardless of whether the hood 118 is tied in the open or in the closed position, the mesh portion 132 and the screen mesh 134 provide ventilation to the inside compartment of the tent 30, as well as shielding the interior of the tent 30 from bugs and insects.

FIG. 6 illustrates an additional modification that may be made to the tent 30 of the present invention. For example, rods 146 and 150 are provided in a manner perpendicular to each other to provide further support to the upper portion of the tent and, in particular, the roof 86. Openings 154 are provided at an upper central portion of each side panel for receiving the ends of the rods 146 and 150. A retaining member 158 is fixed at the central point of the roof 86 and holds the rods 146 and 150 perpendicular to each other in such a manner that each end of the rod 146 or 150 is fitted through a guide 162 and its corresponding opening 154. This provides more stability to the roof 86 of the tent 30.

FIG. 7 illustrates a second embodiment 200 of the tent of the present invention wherein the tent 200 is provided with six inclined triangular side panels as opposed to the four triangular side panels shown in the embodiment of FIG. 1. As with the embodiment of FIG. 1, each side panel 204 is provided with a separate frame member 208 to provide the necessary stable support.

FIG. 8 illustrates a third embodiment 230 of the tent of the present invention wherein five inclined triangular side panels 234 supported by five frame members 238 are provided.

Figure 9:
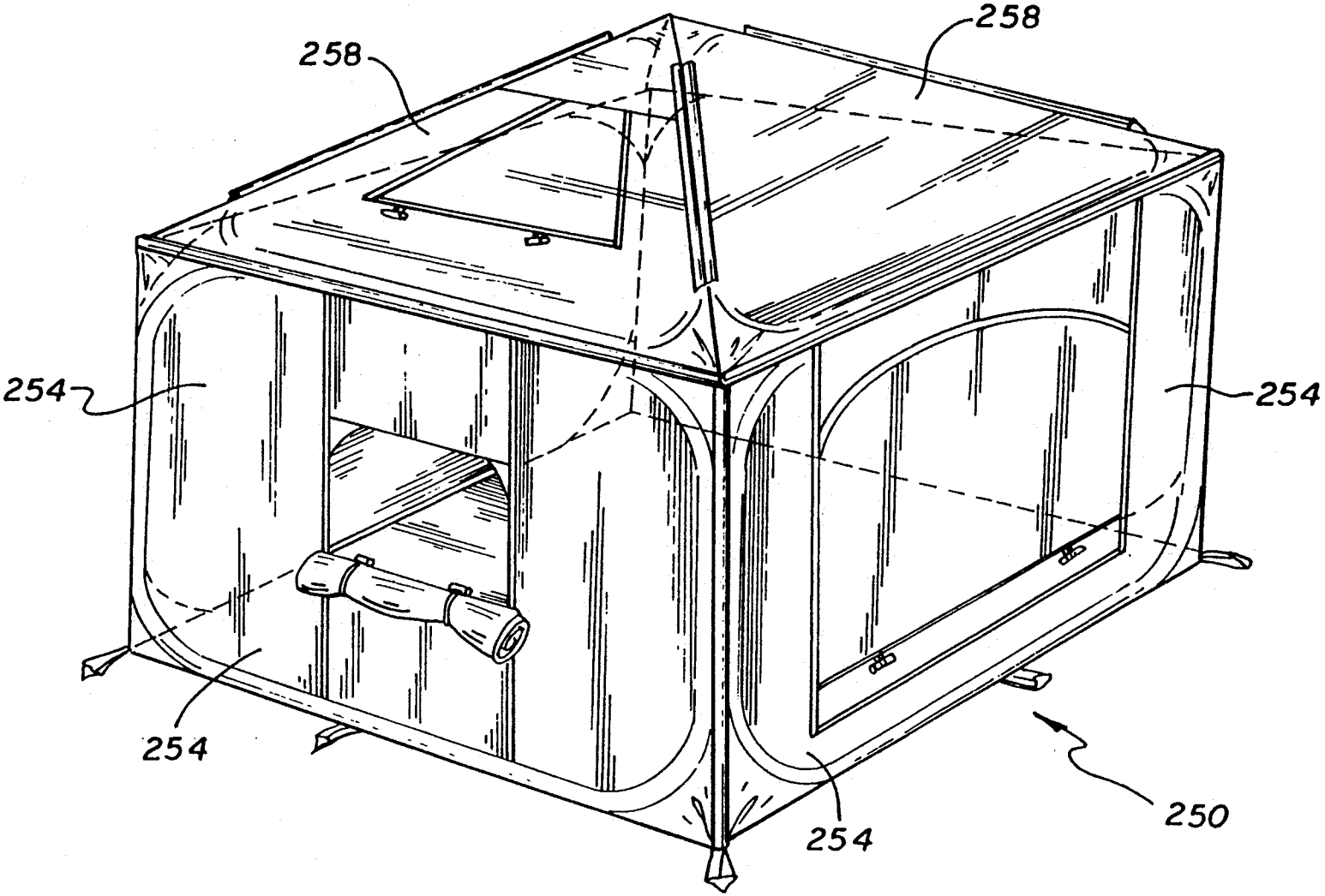
FIG. 9 is a fourth embodiment of the collapsible shade structure having four rectangular side panels and a roof comprising two triangular panels.

FIG. 9 illustrates a fourth embodiment 250 of the tent of the present invention wherein four rectangular side panels 254 are provided but are arranged to stand vertically as opposed to being inclined at an angle so as to form a rectangular internal block or space. The roof in the embodiment of FIG. 9 may be formed by two triangular-shaped frame members 258 which ma be folded one upon the other when the tent is folded up.

Figure 10:
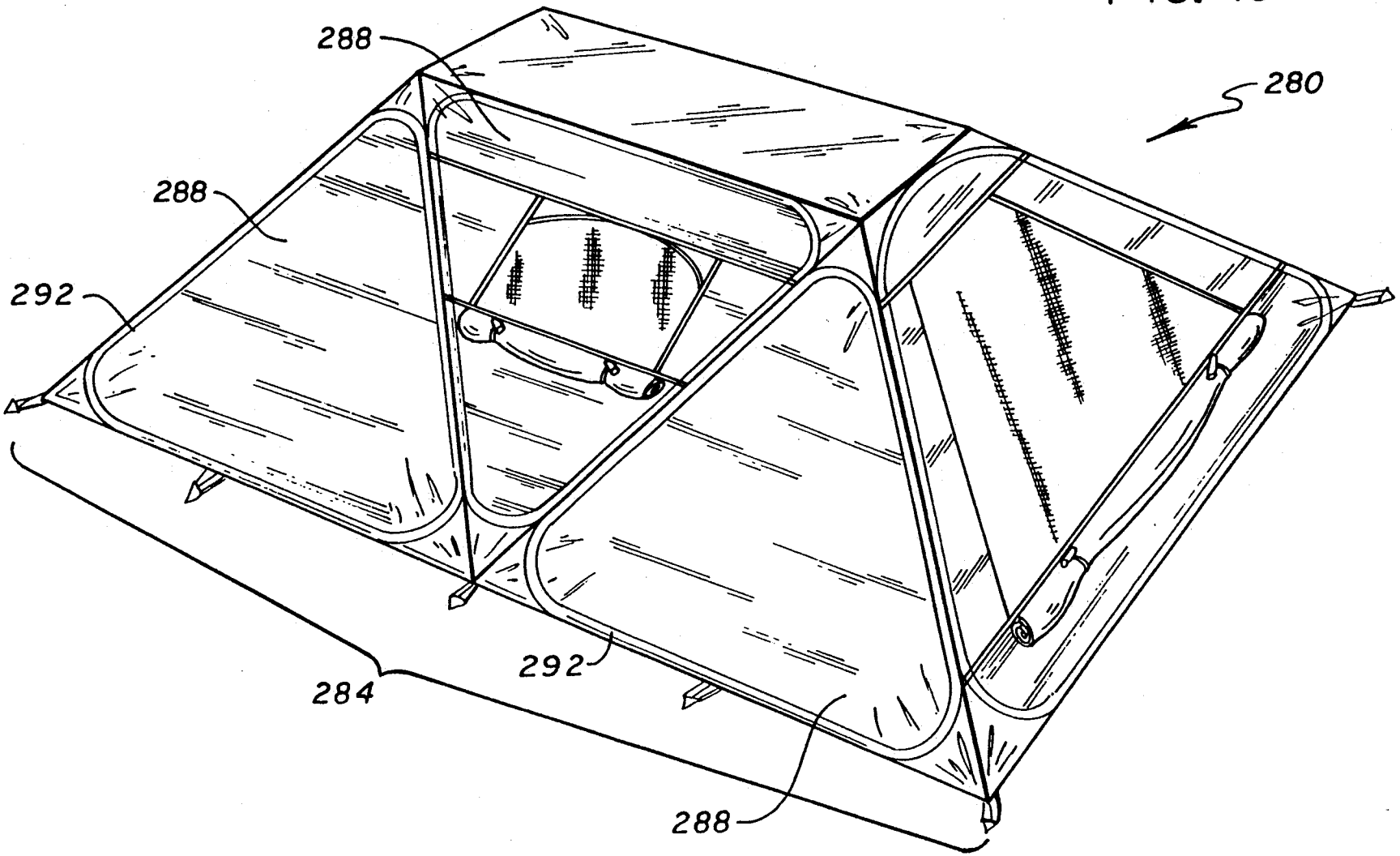
FIG. 10 is a fifth embodiment similar to the embodiment of FIG. 1, having three triangular side panels along two of the sides thereof.

FIG. 10 illustrates a fifth embodiment 280 of the tent of the present invention wherein two opposing walls 284 may be lengthened by providing three inclined side panels 288 to comprise each wall 284, each side panel 288 supported by a separate frame member 292.

It can be seen, therefore, that the tent of the present invention may take a variety of external shapes. These external shapes are facilitated by the provision of additional frame members configured to form the desired shape. Each side of the tent, regardless of the shape, is supported by at least one frame member. The tent may be of any size but is commonly of such a size as to accommodate one or more persons.

Figure 11A:
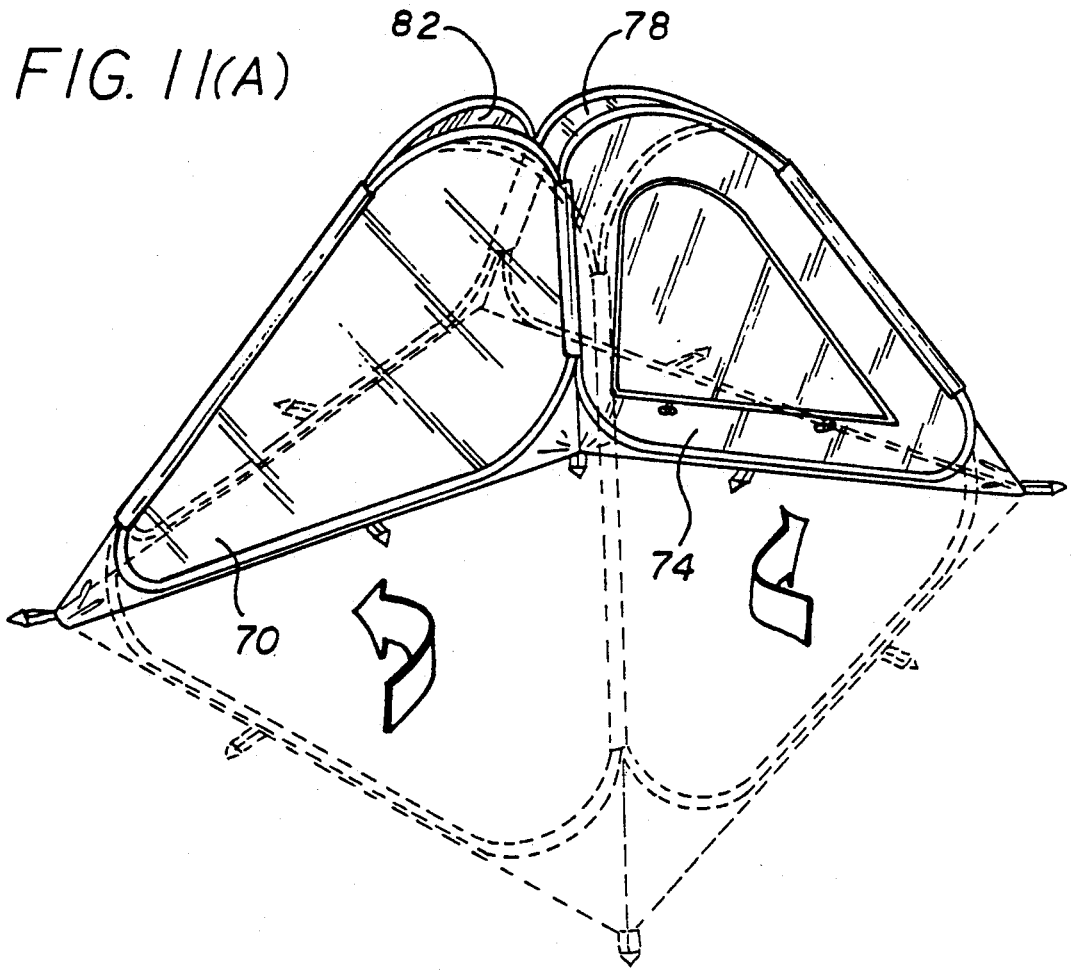
Figure 11B:
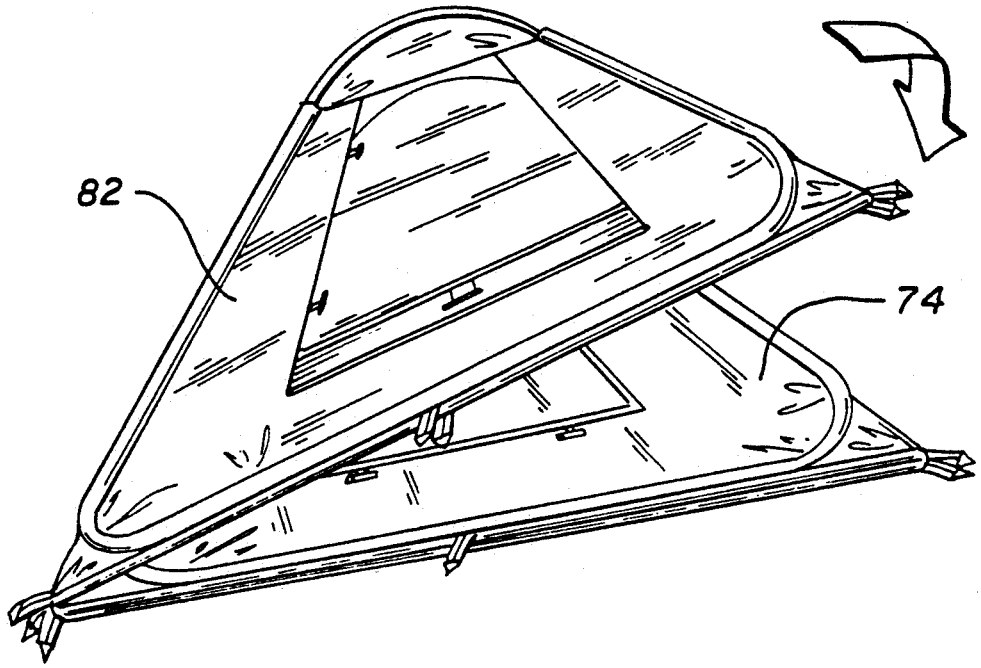
Figure 11C:
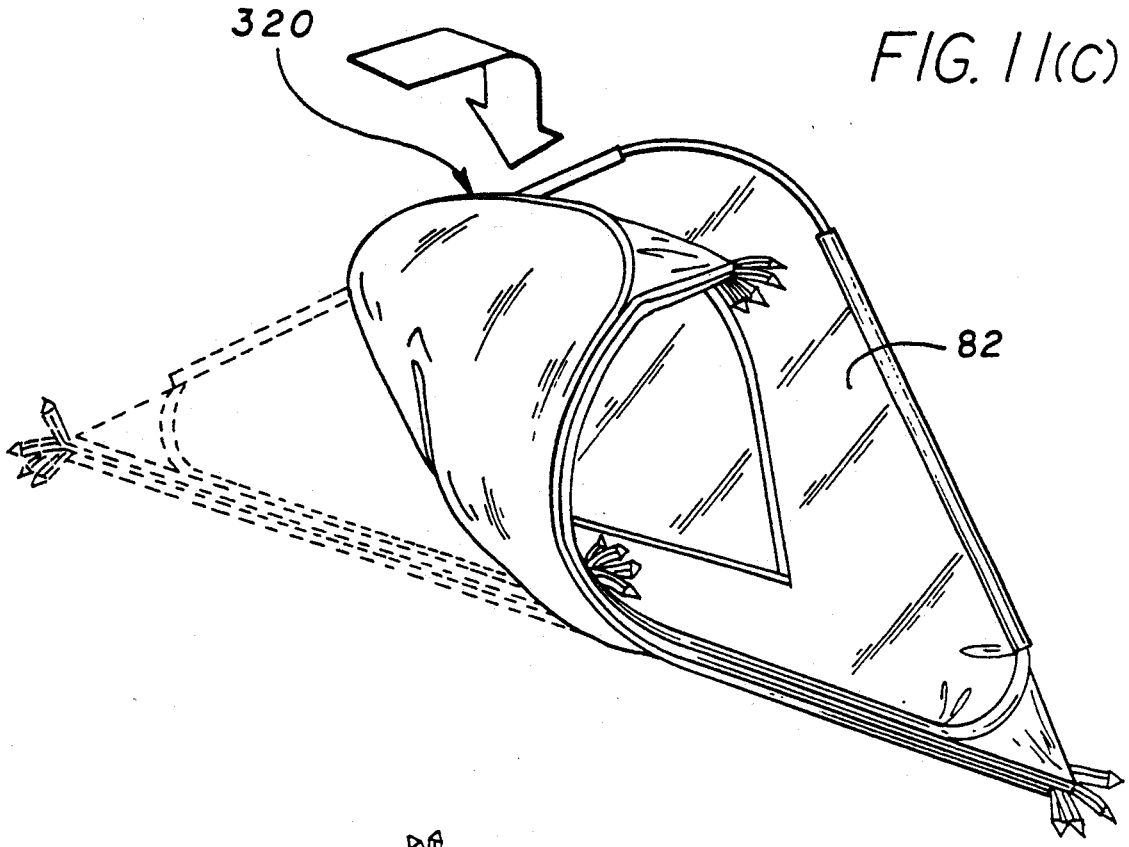
Figure 11D:
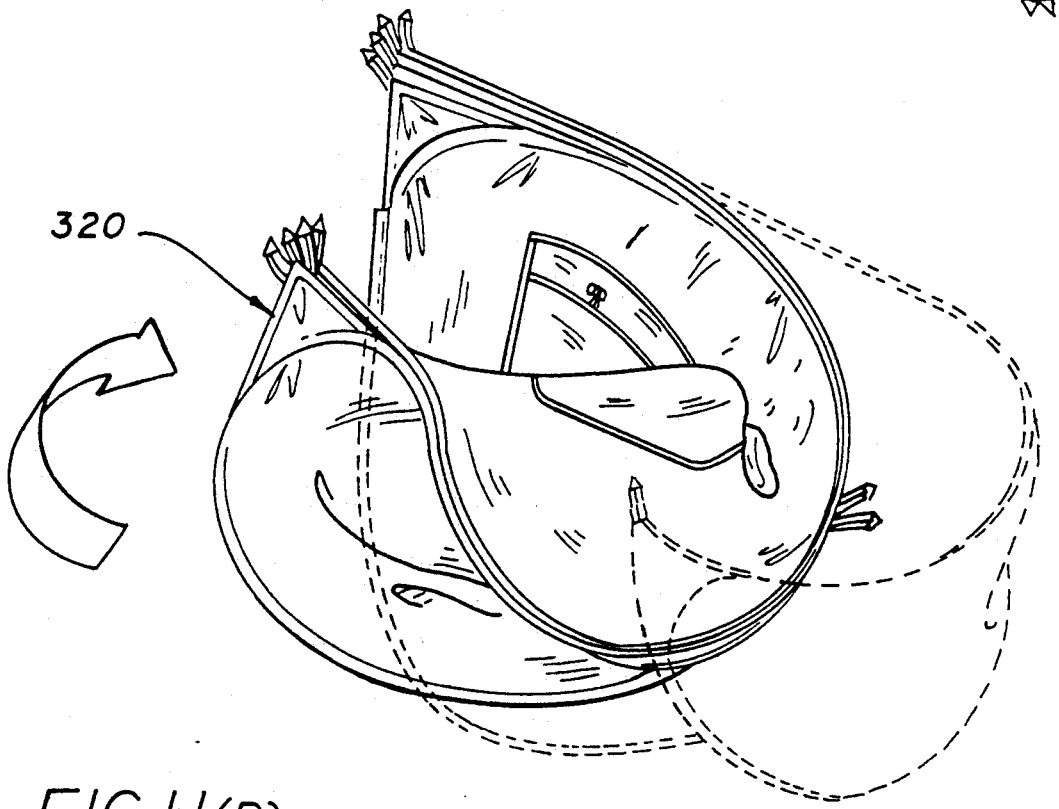

FIGS. 11(A) through 11(F) describe the various steps for folding the tent 30 of the embodiment of FIGS. 1-5 for storage. In FIG. 11(A), the first step consists of pushing in side panels 70 and 74 such that side panel 70 collapses upon side panel 82 and side panel 74 collapses upon side panel 78. Then, in the second step shown in FIG. 11(B), the two side panels 70 and 82 are folded so as to be collapsed upon the two side panels 74 and 78. The structure is twisted and folded to collapse the frame members and side panels into a smaller shape. In the third step shown in FIGS. 11(C) and 11(D), the opposite border 320 of the structure is folded in upon the previous fold to further collapse the frame members with the side panels. As shown in FIG. 11(E), the fourth step is to continue the collapsing so that the initial size of the structure is reduced. FIG. 11(F) shows the fifth step with the frame members and side panels collapsed on each other to provide for a small essentially compact configuration having a plurality of concentric frame members and layers of the side panels so that the collapsed structure has a size which is a fraction of the size of the initial structure.

Therefore, the present invention provides a collapsible shade structure in which each side panel is supported by at least one frame member to provide stable support for the entire structure. The collapsible shade structure may be easily collapsed by folding and twisting the frame members and the side panels to cause the frame members to collapse within themselves to form smaller concentric frame members and layers of side panels to create a compact folded configuration which may be stored and transported very easily.

Figure 12:
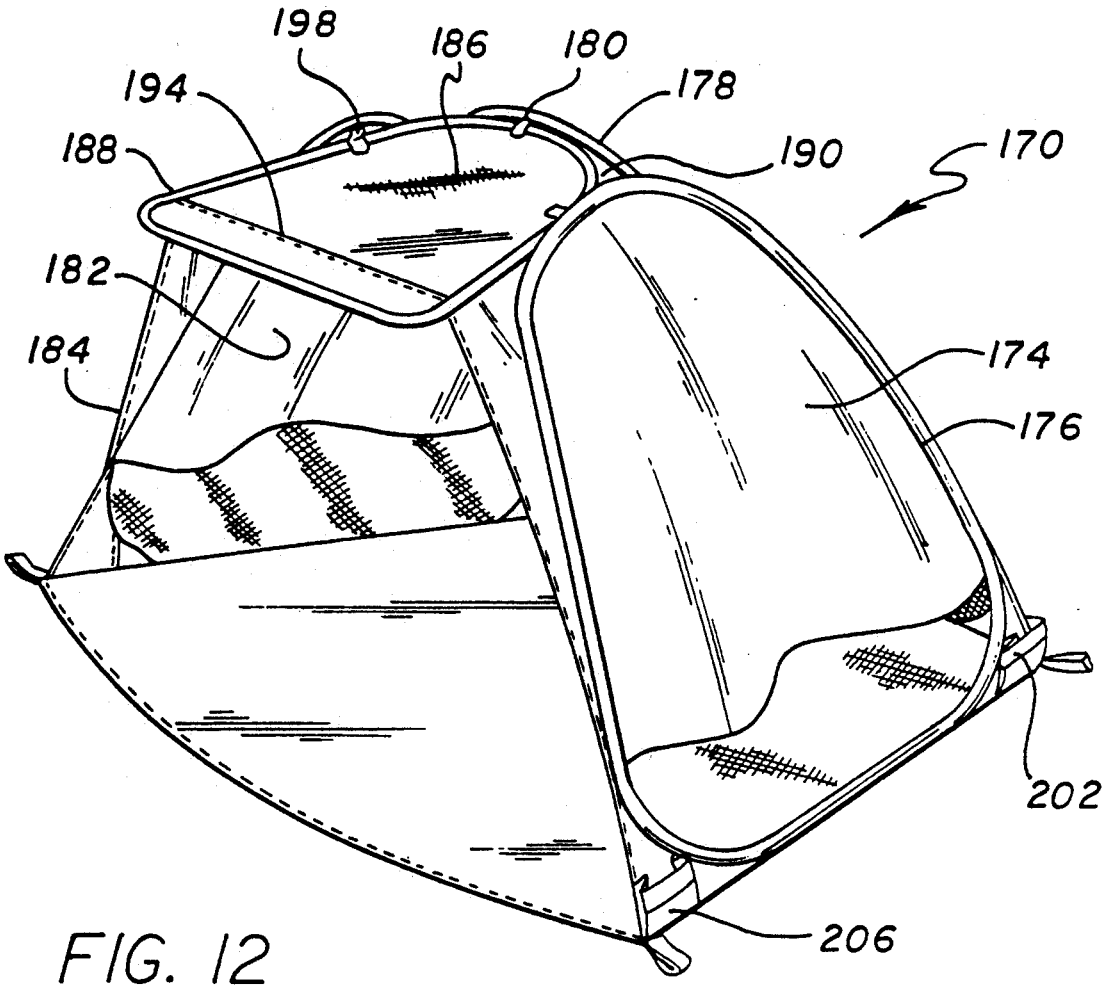
FIG. 12 is a perspective view of a further embodiment of the collapsible shade structure which may be used as a cabana, showing a side panel acting as a door in an open position exposing the interior of the cabana; an FIG. 13 is a perspective view of one of the corners of the cabana of FIG. 12.
Figure 13:
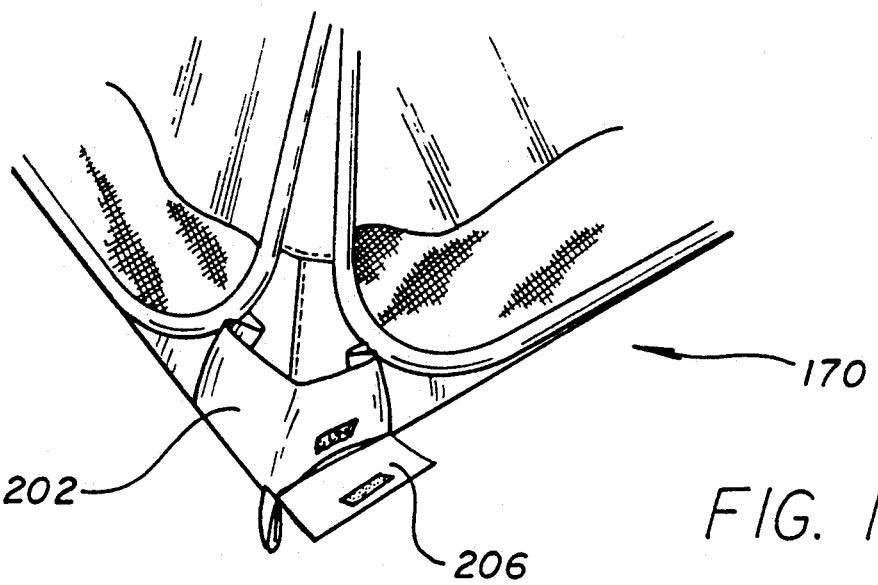

Referring to FIG. 12, the collapsible shade structure of the present invention may take the form of a cabana 170. The cabana 170 is comprised of three side panels 174, 178 and 182, each supported by a frame member, 176, 180 and 184, respectively. The cabana 170 also has a mesh door 186 which is also supported by a frame member 188. The mesh door 186 is sewn to the roof 190 along a hinged edge 194 so that the mesh door may be flipped up or down about the hinged edge 194. The mesh door 186 may be flipped to an open position such as that shown in FIG. 12 and held in place atop the roof 190 by means of "Velcro" pads 198. As shown in FIG. 13, the four corners of the cabana may be provided with pockets 202 which are used to collect sand. Each pocket 202 is provided with a flap 206, which is normally secured to the pocket 202 by means of "Velcro" pads, but the flap 206 may be opened to allow the sand collected therein to be emptied.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims ar therefore intended to be embraced therein.

What is claimed is:

1. A collapsible shade structure supported on a surface for defining and enclosing an interior space, the shade structure comprising:

at least three foldable triangular frame members each having a folded and an unfolded orientation, each frame member comprising three sides and three rounded apexes forming a continuous loop in the unfolded orientation;

the three sides of each frame member comprising a first side, a second side and a third side and the three rounded apexes comprising a first apex, a second apex and a third apex, with the first side extending from the first apex to the second apex, the second side extending from the first apex to the third apex, and the third side extending from the second apex to the third apex;

a fabric material substantially covering the frame members to form a side panel for each frame member, each side panel having upper portions and assuming the unfolded orientation of its associated frame member;

wherein the first side of each frame member and its associated side panel is connected to an adjacent frame member and its associated side panel by an interconnecting portion of the fabric material forming a first hinge portion, with the first hinge portion extending from the first apex to the second apex, and wherein the second side is connected to another adjacent frame member and its associated side panel by another interconnecting portion of the fabric material forming a second hinge portion, with the second hinge portion extending from the first apex to the third apex;

the frame members and their associated side panels held together to form an enclosed interior space with the third side of each frame member resting on the surface to support the shade structure; and a roof interconnecting the upper portion of the side panels to enclose the interior space.

2. The collapsible shade structure of claim 1 wherein the frame members are made of metal.

3. The collapsible shade structure of claim 1 wherein the fabric material is provided with internal frame retaining sleeves for retaining the frame members.

4. The collapsible shade structure of claim 1 wherein the fabric material is formed as two layers and with the frame members retained within the two layers of fabric material.

5. The collapsible shade structure of claim 1 further including a floor portion interconnecting lower portions of the side panels.

6. The collapsible shade structure of claim 5, further including a plurality of ties for securing the structure to the ground.

7. The collapsible shade structure of claim 6 wherein one of the side panels is provided with a door for ingress and egress.

8. The collapsible shade structure of claim 7 wherein the door has a screen for ventilating air.

9. The collapsible shade structure of claim 8 further including at least one vent for providing ventilation to the interior of the structure.

10. The collapsible shade structure of claim 9 wherein the vent may assume either an open or a closed position, the vent being further provided with a screen mesh.

11. The collapsible shade structure of claim 10, wherein the vent further comprises a hook attached to the vent, and a strap having a first end connected to the third side of the frame member and a second end adapted to be coupled to the hook to hold the vent in the open position.

12. The collapsible shade structure of claim 1 wherein the side panels and their corresponding frame members are urged on top of each other about the hinge portions to have the side panels and frame members overlying each other, and with the overlaying side panels and frame members collapsible to the folded orientation by twisting and folding to form a plurality of concentric frame members and side panels to substantially reduce the size of the shade structure in the folded orientation.

13. The collapsible shade structure of claim 1 wherein the side panels are held together with each side panel vertically inclined at an angle to create a domed structure in which the interior area of the structure gradually decreases from the bottom to the top.

14. A method of collapsing a collapsible shade structure supported on a surface for defining and enclosing an interior space, the shade structure comprising at least three foldable triangular frame members each having a folded and an unfolded orientation, each frame member comprising three sides and three rounded apexes forming a continuous loop in the unfolded orientation, the three sides of each frame member comprising a first side, a second side and a third side and the three rounded apexes comprising a first apex, a second apex and a third apex, with the first side extending from the first apex to the second apex, the second side extending from the first apex to the third apex, and the third side extending from the second apex to the third apex, the shade structure further comprising a fabric material substantially covering the frame members to form a side panel for each frame member, with the first side of each frame member and its associated side panel connected to an adjacent frame member and its associated side panel by an interconnecting portion of the fabric material forming a first hinge portion, with the first hinge portion extending from the first apex to the second apex, and the second side connected to another adjacent frame member and its associated side panel by another interconnecting portion of the fabric material forming a second hinge portion, with the second hinge portion extending from the first apex to the third apex, and the frame members and their associated side panels held together to form an enclosed interior space with the third side of each frame member resting on the surface to support the shade structure, the method comprising the steps of:

urging the side panels and their corresponding frame members on top of each other about the hinge portions to have the side panels and frame members overlying each other; and twisting and folding the overlaying side panels and frame members to form a plurality of concentric frame members and side panels to substantially reduce the size of the shade structure.

15. The method of claim 14, wherein the step of urging the side panels and their corresponding frame members on top of each other about the hinge portions comprises the step of pushing in at least one side panel against at least one other side panel about the hinge portion between the at least one side panel and the at least one other side panel.

16. A collapsible shade structure supported on a surface, the shade structure comprising:

at least three foldable triangular frame members each having a folded and an unfolded orientation, each frame member comprising three sides and three rounded apexes forming a continuous loop in the unfolded orientation;

the three sides of each frame member comprising a first side, a second side and a third side and the three rounded apexes comprising a first apex, a second apex and a third apex, with the first side extending from the first apex to the second apex, the second side extending from the first apex to the third apex, and the third side extending from the second apex to the third apex;

a fabric material substantially covering the frame members to form a side panel for each frame member, each side panel having upper portions and assuming the unfolded orientation of its associated frame member;

wherein the first side of each frame member and its associated side panel is connected to an adjacent frame member and its associated side panel by an interconnecting portion of the fabric material forming a first hinge portion, with the first hinge portion extending from the first apex to the second apex, and wherein the second side is connected to another adjacent frame member and its associated side panel by another interconnecting portion of the fabric material forming a second hinge portion, with the second hinge portion extending from the first apex to the third apex; and the frame members and their associated side panels held together with the third side of each frame member resting on the surface to support the shade structure;

wherein the side panels and their corresponding frame members are urged on top of each other about the hinge portions to have the side panels and frame members overlying each other, and with the overlaying side panels and frame members collapsible to the folded orientation by twisting and folding to form a plurality of concentric frame members and side panels to substantially reduce the size of the shade structure in the folded orientation.

* * * * *